United States Patent [19]

Howard et al.

[11] Patent Number: 4,845,482

[45] Date of Patent: Jul. 4, 1989

[54] METHOD FOR ELIMINATING CROSSTALK IN A THIN FILM TRANSISTOR/LIQUID CRYSTAL DISPLAY

[75] Inventors: Webster E. Howard; Paul M. Alt, both of Yorktown Heights, N.Y.

[73] Assignee: International Business Machines Corporation, Armonk, N.Y.

[21] Appl. No.: 115,224

[22] Filed: Oct. 30, 1987

[51] Int. Cl.[4] ..... G09G 3/00

[52] U.S. Cl. ..... 340/805; 340/784; 350/333

[58] Field of Search ..... 340/718, 719, 784, 805; 350/331 R, 332, 333; 358/236

[56] References Cited

U.S. PATENT DOCUMENTS

| | | | |
|---|---|---|---|
| 3,532,813 | 10/1970 | Lechner | 340/784 |
| 3,765,011 | 10/1973 | Sawyer et al. | 340/713 |
| 3,955,187 | 4/1976 | Bigelow | 340/784 |
| 3,995,942 | 12/1976 | Kawakami et al. | 340/784 |
| 4,485,380 | 11/1984 | Soneda et al. | 340/784 |
| 4,511,926 | 4/1985 | Crossland et al. | 340/784 |
| 4,640,582 | 2/1987 | Oguchi et al. | 350/333 |
| 4,649,383 | 3/1987 | Takeda et al. | 340/784 |
| 4,655,550 | 4/1987 | Crossland et al. | 350/332 |
| 4,660,030 | 4/1987 | Maezawa | 340/784 |
| 4,702,560 | 10/1987 | Endo et al. | 340/784 |
| 4,703,305 | 10/1987 | Ayliffe | 340/805 |
| 4,712,876 | 12/1987 | Umeda et al. | 340/784 |

*Primary Examiner*—Gerald L. Brigance
*Assistant Examiner*—Mike Fatahiyar
*Attorney, Agent, or Firm*—Jack M. Arnold

[57] ABSTRACT

The elimination of crosstalk between data lines and pixel cells in a thin film transistor/liquid crystal display is accomplished by applying a data signal to a given data line for a time period less than the standard scan line period of the display, and applying a crosstalk compensation signal to the given data line for the remainder of the scan line period.

18 Claims, 6 Drawing Sheets

FIG. 4
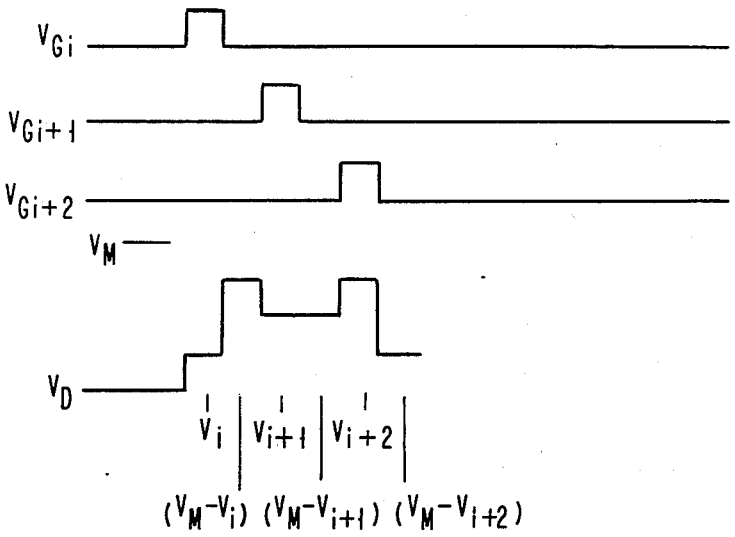
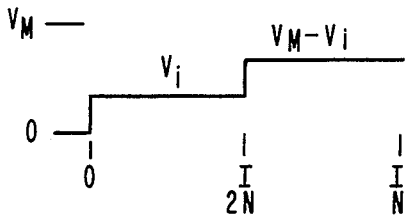
FIG. 5
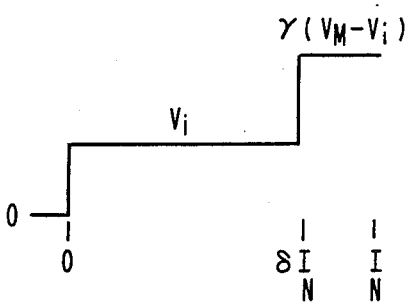
FIG. 6

FULL FRAME BUFFER:
SERIAL DATA BY ROW
(e.g. FROM VIDEO RAM
EACH ROW ACCESSED TWICE:
R1,R1,R2,R2,R3,R3,...
PEL CLOCK
δ T/N OR
T/2N STROBE
T/N SYNCH
GATE DRIVE RESET
ANALOG TOGGLE
COLUMN SHIFT REGISTER
ANALOG SWITCH
FLIP/FLOP
GATE DRIVE SHIFT REGISTER
ENABLE
CLOCK
RESET
T/2N
T/N
Vc

METHOD FOR ELIMINATING CROSSTALK IN A THIN FILM TRANSISTOR/LIQUID CRYSTAL DISPLAY

TECHNICAL FIELD

The invention is in the field of thin film transistor/liquid crystal displays (TFT/LCD's). In particular, a method is set forth for eliminating crosstalk in TFT/LCD's.

BACKGROUND ART

Thin film transistor/liquid crystal displays appear to be the emerging display technology of choice. Worldwide efforts exist to develop this technology into practical display products. Crosstalk is high on the list of problems to be solved. This is a problem of coupling information intended for a picture element on a column into other picture elements on that column and adjacent columns. The resulting undesirable effects are visible on the screen. The cause is the parasitic (geometrical) capacitance between the column or data line and the conductor pad which defines the pixel. Even though the transistor connecting the data line to the pad may be turned off, the parasitic capacitance causes a fraction of the data voltage to appear on the pad, that is, across the liquid crystal pixel.

There are a number of prior art patents which directly or indirectly address the problem of crosstalk, although most of these deal with different types of crosstalk associated with conventional matrix liquid crystal displays.

U.S. Pat. No. 4,655,550 to Crossland et al is directed to a ferro-electric liquid crystal display in which the individual pixels are addressed via an address matrix that includes one field effect transistor for each pixel and a plurality of row and column conductors whereby data is written into each pixel to change or to maintain its display condition. Crosstalk is reduced by applying voltage selectively to only those pixels which are to be accessed.

U.S. Pat. No. 3,995,942 to Kawakami et al is directed to a method of driving a matrix type liquid crystal display device. Crosstalk between liquid crystal cells is reduced through the use of a bias voltage pulse.

U.S. Pat. No. 3,765,011 to Sawyer et al is directed to a flat panel image display having an addressing scheme utilizing 2 terminal breakdown switches.

U.S. Pat. No. 3,532,813 to Lechner is directed to a liquid crystal display that overcomes first order crosstalk of a simple X-Y addressing scheme, but is not applicable to other forms of crosstalk.

U.S. Pat. No. 4,660,030 to Maezawa is directed to an improved liquid crystal video display device. An interlacing video display technique is utilized and scanning signals are provided to every other scanning electrode line in sequential order, shifting selected lines every frame. An additional selected voltage is provided during the time period which overlaps the selected scanning electrode lines to the adjacent non-selected electrodes both above and below the selected scanning electrode lines. A high resolution display is provided while reducing associated flicker by driving all scanning lines in the desired order.

U.S. Pat. No. 4,640,582 to Oguchi et al is directed to a system for driving a liquid crystal matrix display for use in a television wherein the signal applied to each pixel is inverted at a rate not greater than that necessary to scan a single pixel but greater than the rate necessary to cause crosstalk and in any event greater than the rate necessary to scan a line of pixels without inverting.

According to the present invention, the elimination of crosstalk between data lines and pixel cells in a TFT/LCD is accomplished by applying a data signal to a given data line for a time period less than the standard scan line period of the display, and applying a crosstalk compensation signal to the given data line for the remainder of the scan line period.

DISCLOSURE OF THE INVENTION

A method is disclosed for reducing crosstalk in a display comprised of a matrix of thin film transistor/liquid crystal display cells, with each cell being defined by the orthogonal intersection of one of a first plurality of data lines and one of a second plurality of gate lines. A given cell is turned on in response to the data line and the gate line that intersects at the cell having a data signal and a gating signal, respectively, applied thereto. The gating signal applied to the one gate line is turned on for a selected time which is less than the standard scan line period of the display, and is turned off for the remainder of the scan line period. A data signal is applied to the one data line during the time the gating signal is on, and a crosstalk compensation signal is applied to the one data line during the time the gating signal is off.

BRIEF DESCRIPTION OF THE DRAWINGS

FIGS. 4, 5 and 6 are diagrams of the waveforms applied to a data line in a TFT/LCD array;

BEST MODE OF CARRYING OUT THE INVENTION

Figure 1:
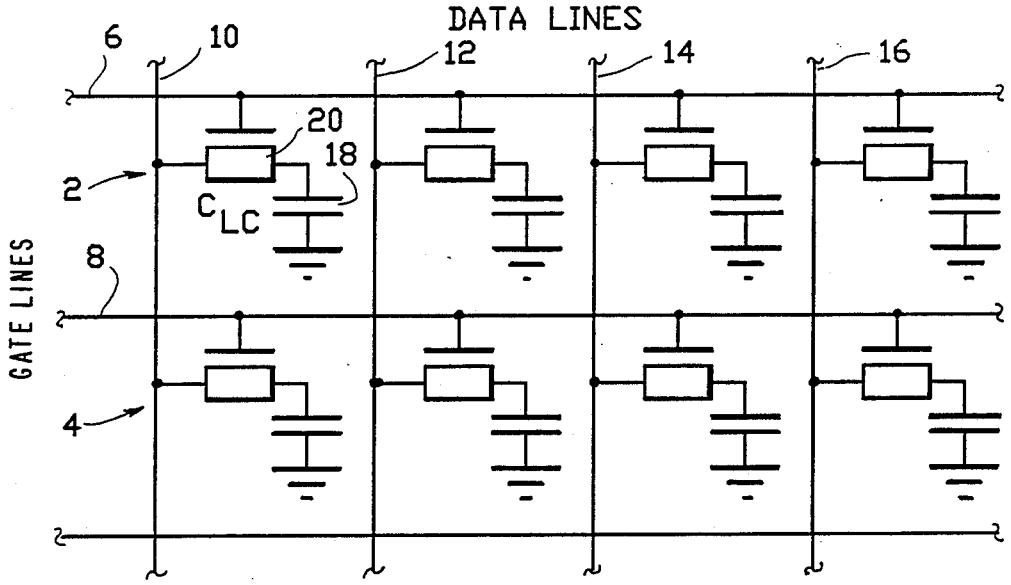
FIG. 1 is a schematic diagram of a TFT/LCD array.

The use of thin film transistors in conjunction with liquid crystals offers many benefits in improved image quality relative to what is achieved in conventional multiplexed matrix liquid crystal displays. In a LC/TFT display, a matrix of liquid crystal cells is controlled by means of an x-y array of thin film transistors, one per cell, which can be switched on, a row at a time, to control the charge on the corresponding row of liquid crystal electrodes, thereby determining the visible state of those liquid crystal cells. FIG. 1 shows the equivalent circuit of such an array, which is identical electrically to that of a one-device-cell dynamic memory (DRAM). As each row of transistors 2 and 4 is turned on by a pulse applied to gate lines 6 and 8, respectively, and in turn on the corresponding horizontal gate electrode, the voltages on the vertical data electrodes 10, 12, 14 and 16 are transferred to the cell capacitors, for example cell capacitor 18 associated with transistor 20, which consist of the liquid crystal cell itself as well as, in some cases, an additional thin film storage capacitor. If this charging process is repeated at a sufficiently high rate, then the charge on the liquid crystal elements can be maintained and a visible image is produced which corresponds to the data voltages. The transistor here is viewed as an ideal switch, which allows charge to flow only during the time of the gate line activation and prevents any charge from leaking off the capacitor while the other rows are being addressed. Such ideal behavior is not, however, a necessary condition of the invention.

Figure 2:
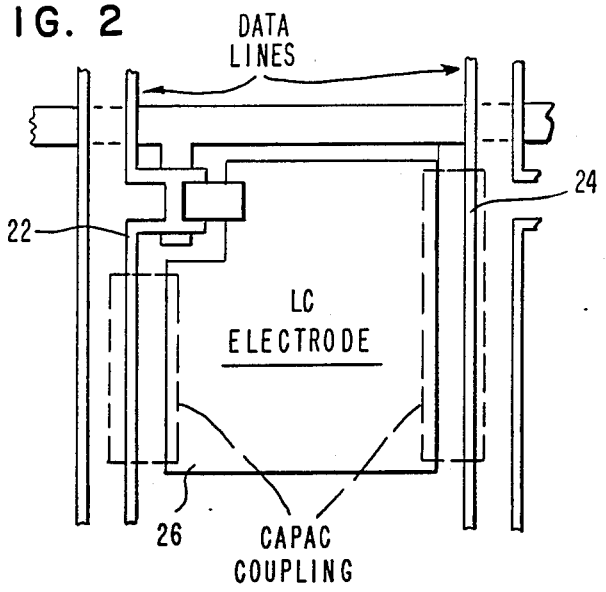
FIG. 2 is a typical cell layout for a TFT/LCD array.

Real arrays suffer from various non ideal characteristics which act to reduce the quality of the displayed image. One of the most important of these is crosstalk, whereby the data voltage applied to a vertical electrode can influence even those cells for which the transistor is in an OFF condition. The principal means by which this can occur is by capacitive coupling, which effectively bypasses the transistor switch with AC current. This is a consequence of the fact that liquid crystals can respond to AC voltage as well as to DC excitation. The dominant, but not the only, source of bypass coupling is the capacitance between the data electrodes 22 and 24 and the transparent liquid crystal electrode 26, as shown schematically in FIG. 2, which is a representation of the cell layout of a typical LC/TFT cell. The coupling capacitor and the cell capacitance then constitute a capacitive divider, such that a fraction of the data voltage at any time is across the liquid crystal. Since the voltage on a given column electrode consists of a repetitive serial sequence of the data voltages for all the elements of that column, a given liquid crystal cell capacitor will be subjected to a fraction of all the voltages in the column, in sequence, with the fraction depending upon the size of the coupling capacitor relative to the cell capacitance. For typical geometries and typical cell capacitances, this crosstalk signal is significant and leads to visible artifacts in grayscale images. The usual responses to this problem consists of (1) avoiding grayscale, that is, making the liquid crystal cell insensitive to small changes of voltage by operating in a saturated response regime, or (2) adding more cell capacitance, to reduce the relative influence of the coupling capacitor.

The former approach severely limits the display function, since the accurate rendition of many images requires grayscale, and since even graphic images can be improved visually by using grayscale (antialiasing). The second approach, which is the most common for television displays, suffers from the drawback that the addition of thin film capacitance to each cell has a serious adverse impact on the manufacturing yield of such displays, since it is difficult to make large areas of thin film dielectric without some shorting defects.

Figure 3:
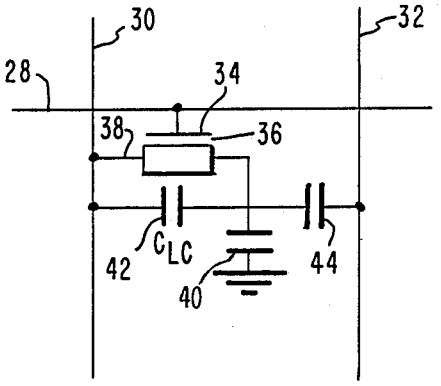
FIG. 3 is a schematic diagram representation of the cell layout of FIG. 2.

What is disclosed here, as shown in FIG. 3, is a method of reducing greatly the crosstalk due to capacitive coupling, by means of a novel addressing approach. In the conventional approach, the row gate electrodes 28 are strobed in sequence, each one being activated once per frame time T, for an interval of approximately T/N, where N is the number of rows in the display. Each column data electrode, such as 30 or 32, then has a repetitive sequence of voltages, $V_i$, each for a time interval T/N in synchronization with the gate pulses. In contrast, the proposed method consists of applying the gate pulse for a fraction of the line time, for example, for only half of the line time T/N, i.e. for T/2N seconds to the gate electrode 34 of transistor 36, and changing the sequence of data line voltages applied to source electrode 38 to $V_i$, $V_M-V_i$, $V_{i+1}$, $V_M-V_{i+1}$, etc., where $V_M$ is a fixed voltage (which could be zero). Essentially, this addressing sequence is one of data, data complement, data, data complement, etc., with the gate pulses synchronized to the intervals of the data voltage for transferring charge to the cell capacitance 40. The data complement pulses are driving the column electrodes when there are no gate pulses active, i.e., when all transistors are off, thereby compensating the effect of crosstalk via capacitive coupling by the cell capacitances 42 and 44.

This scheme is illustrated in FIG. 4, which shows a typical set of waveforms. It is very straightforward to calculate the rms voltage at the liquid crystal resulting from such a waveform, assuming a coupling factor $\alpha$ associated with the bypass capacitance and assuming that there is no decay of the charge transferred to the cell capacitance 40 when the transistor is gated off. Allowing for such a decay will not substantially alter the results. One important further aspect of the drive not yet mentioned, however, is that liquid crystals require AC drive, to avoid potential effects of ionic conductivity. This is usually accomplished by reversing the voltage at the end of each scan frame. Taking this into account leads to an expression for the rms voltage which contains a term involving the row number; specifically, there is an error voltage which varies smoothly from the top of the display to the bottom. This, however, is easily compensated in the drive circuitry.

The expression for the rms voltage at the ith row position is then given by:

$$<V^2>_i = 1/2N \sum_{j>i}^{N} [(V_i(1-\alpha) + \alpha V_j)^2 + (V_i(1-\alpha) + \alpha(V_M - V_j))^2] + 1/2N\,[V_i^2 + (V_i(1-\alpha) + \alpha(V_M - V_i))^2] + 1/2N \sum_{j=1}^{i-1} [(V_i(1-\alpha) - \alpha V_j)^2 + (V_i(1-\alpha) - \alpha(V_M - V_j))^2]$$

It can be seen by expanding this expression that there is a cancellation of terms linear in $\alpha$ and in $V_j$, which would normally be the dominant crosstalk terms. The expression then becomes:

$$<V^2>_i = V_i^2((1-\alpha)^2/N) + \alpha V_i V_M(1-\alpha)((N+2-2i)/N) + \alpha^2/2N \sum_{j=1}^{N} [(V_M - V_j)^2 + V_j^2]$$

The first term represents a small gain correction; the second term is a correction which varies smoothly from top to bottom of the display. This could be corrected easily with an analog circuit. The last term represents the remaining crosstalk, which is a second order term proportional to $\alpha^2$.

These expressions include only the terms describing the coupling from the data line to the LC electrode. There is also a coupling from the adjacent data electrode, as indicated in FIG. 3, but this can be included in a straightforward way, with the same cancellation. If one assigns a coupling coefficient $\beta$ for the adjacent data electrode, then the top-to-bottom correction is proportional to $(\alpha+\beta)$, and there are additional second order corrections proportional to $\alpha^2$ and $2\alpha\beta$.

These waveforms can be generated from a conventional serial data stream by simple analog means, although such drivers will very likely cost more than conventional drivers. The most serious drawback is the requirement of a factor of two in speed, the T/2N line time.

The crosstalk reduction scheme described above has the disadvantage of requiring the addressing circuits to switch at twice the speed that conventional schemes require. Thus TFT's must be made to switch faster and the transmission lines feeding them (the gate and data lines) must also be engineered for enhanced speed.

An additional concept in general terms is that while still using the concept of a data signal plus a compensation signal per line time (T/N), one can trade a longer duration data signal time for a shorter duration compensation signal with increased amplitude. What must be preserved is the RMS contribution of the two signals. Specifically, it can be shown that in order for the first order crosstalk terms to cancel the following relationship must hold:

$$\gamma^2=\delta/(1-\delta)$$

where, as shown in FIG. 4, the following definitions apply.

$\delta$=fraction of line time that gate/data signal is ON, and can be any value in the range $0 \leqq \delta \leqq 1$.

$\gamma$=scaling factor for compensation pulse amplitude as defined above, and corresponding to the chosen $\delta$ value.

By way of examples, the earlier discussed case as shown in FIG. 5 has $\delta=0.5$ and $\gamma=1$. That is, the gate/-data signal is on for half the line time at amplitude $V_i$ and the compensation signal is on for half the line time at amplitude $(V_M - V_i)$. Alternatively, one could choose to operate, as shown in FIG. 6, at say $\delta=0.8$ and $\gamma=2$. In this case, the gate/data signal is on for 80% of the line time at amplitude $V_i$ and the compensation signal is on for 20% of the time with amplitude $2(V_M-V_i)$. One can thus buy back additional time for addressing at the cost of slightly larger compensation signals.

The compensation signal defined by $(V_M-V_i)$ can be derived from any convenient value of $V_M$, including zero. The compensation signal can therefore be either the same or opposite polarity as $V_i$, or can be larger or smaller than $V_i$ in amplitude, depending on the specific TFT/LCD technology utilized.

The implementation is straight forward in that a simple scaling of the compensation signal is involved. One circuit, common to the entire display, can generate the scaling factor in response to a setting of the gate/data pulse width.

Figure 7:
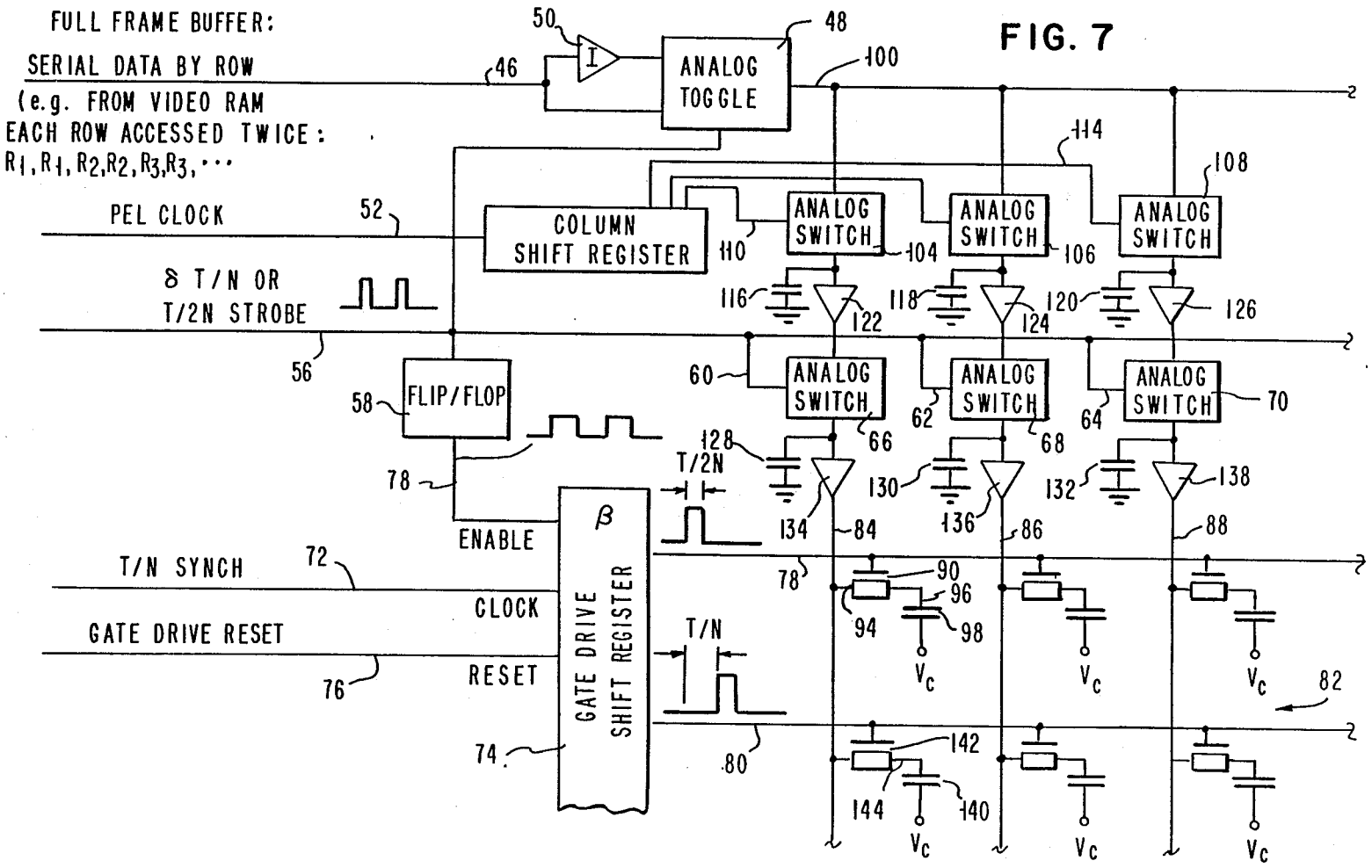
FIG. 7 is a schematic diagram of the addressing circuits for generating the gating signal, data signal and crosstalk compensation signal for the TFT/LCD array.

FIG. 7 illustrates an addressing implementation for the invention. Serial data by row, which for example could be provided from a frame buffer (not shown) is provided via line 46 to a first input of an analog toggle 48 and to the input of an inverter 50. A pel clock signal is provided on a line 52 to a column shift register 54. A strobe signal is provided on line 56 to the input of a flip flop 58 and the gating inputs 60, 62 and 64 of analog switched 66, 68 and 70, respectively, as well as to the trigger input of the toggle 48. A synch signal is provided via line 72 to the clock input of a gate drive shift register 74. A gate drive reset signal is provided via line 76 to the reset terminal of shift register 74, and an enable input is provided via line 78 from flip flop 78 to the enable terminal of shift register 74.

The shift register 74 provides gating signals via row lines 78 and 80 to a TFT/LCD 82 which is formed by the intersection of row lines 78 and 80 with column lines 84, 86 and 88, with there being a transistor at each intersection, such as the transistor 90 at the intersection of row 78 and column 84. The transistor 90 has a gate electrode 92 connected to row line 78, a source electrode 94 connected to column line 84 and a drain electrode 96 connected to one terminal of a capacitor 98; the other terminal of which is connected to a reference voltage Vc. As previously explained, the charge on the capacitor 98 is indicative of the presence or absence of a signal at the cell defined by the intersection of column 84 and row 78.

The serial data by row on line 46, from a video ram for example, is provided to the analog toggle 48 and inverter 50. Each row is accessed twice, i.e. R1, R1, R2, R2, R3, R3 . . . This is accomplished by applying the $\delta T/N$ or T/2N strobe on line 56 to the analog toggle 48. As shown in FIG. 5, during the time period 0−T/2N the data signal $V_i$ applied directly to toggle 48 is switched to output line 100. During the time period T/2N−T/N the complement data signal at the output of inverter 50 is switched to the output line 100. In the general sense, when the strobe is $\delta T/N$ and the inverter 50 includes a gain factor $\gamma$, the toggle switching is as shown in FIG. 6. That is, during the period $0-\delta T/N$ the data signal $V_i$ applied directly to toggle 48 is switched to output 100. During the time period $\delta T/N-T/N$ the complement data signal $\gamma\ (V_m-V_i)$ at the output of inverter 50 is switched to the output line 100. As previously explained, the signal during the period 0−T/2N and $0-\delta T/N$ is the data signal, and the signal during the period T/2N−T/N and $\delta T/N-T/N$ is the crosstalk compensation signal.

The composite signal comprised of the data signal and the crosstalk compensation signal, on line 100 is applied to analog switches 104, 106 and 108. Switch 104 is gated on at pel 1 position time for a given scan line, switch 106 is gated on at pel 2 position time for a given scan line, switch 108 is gated on for pel position 3 in a given scan line and so on. The respective gating signals are provided from column shift register 54 at pel 1 time on line 110, pel 2 time on line 112 and pel 3 time on line 114. When the switches 104, 106 and 108 are gated on, the signal on line 100 is stored on capacitors 116, 118 and 120, respectively and provided via amplifiers 122, 124 and 126 to analog switches 66, 68 and 70, respectively.

The analog switches 66, 68 and 70 are switched on and off by the $\delta T/N$ or T/2N strobe on line 56, with the capacitors 128 130 and 132. The charge on these capacitors is indicative of the composite signal on line 100, that is, this accomplishes a serial to parallel conversion of the data. These composite signals in turn are provided via amplifiers 134, 136 and 138 to the column lines 84, 86 and 88, respectively of the TFT/LCD matrix 82.

During the time period 0−T/2N (FIG. 5) or $0-\delta T/N$ (FIG. 6) the gating signal on line 78 is ON and the gating signal on line 80 is OFF. The charge on capacitor 128 is transferred via amplifier 128 to the source electrode 94 of transistor 90. Since there is a gating signal at the gate electrode 92, the data signal is transferred to capacitor 98 for illuminating this cell in the display. As previously set forth, there is a component of crosstalk, i.e. a fraction of this data signal transferred to capacitor 140 associated with transistor 142 via capacitive coupling via the cell capacitance (not shown) between line 84 and the connection between the drain electrode 144 and the capacitor 140, which charges the capacitor 140 to a fraction of the data voltage and thereby effects the grayscale value of this cell. The crosstalk due to cell capacitance was previously discussed relative to FIG. 3.

During the time period T/2N−T/N (FIG. 5) or δT/N−T/N (FIG. 6), the crosstalk compensation signal $V_m - V_i$ or $\gamma$ $(V_m - V_i)$, respectively is applied to column 84 to provide a compensation signal during the absence of a gating signal on line 78. This crosstalk compensation signal is coupled via the cell capacitance, as discussed above, to the capacitor 140 to supplement the fraction of the data signal, i.e., the crosstalk, previously stored in the capacitor in such a way as to provide a uniform constant effect approximately independent of the data. This compensation takes place at all of the cells connected to the column line 84.

It is seen from the above, that immediately after the analog switches 60, 62 and 64 transfer the data signals to capacitors 128, 130 and 132, respectively for application to lines 84, 86 and 88, respectively for application to the matrix 82 during the time period 0−T/2N (FIG. 5) or 0−δT/N (FIG. 6), analog switches 104, 106 and 108 start storing in sequence the crosstalk compensation signals in capacitors 116, 118 and 120 for subsequent application to the matrix during the time periods T/2N−TN (FIG. 5) or δT/N−T/N (FIG. 6).

At scan line 2 time, the gating signal on line 78 is OFF and the gating signal on line 80 is ON and the above is repeated, and so on for each successive row in the matrix.

Figure 8A:
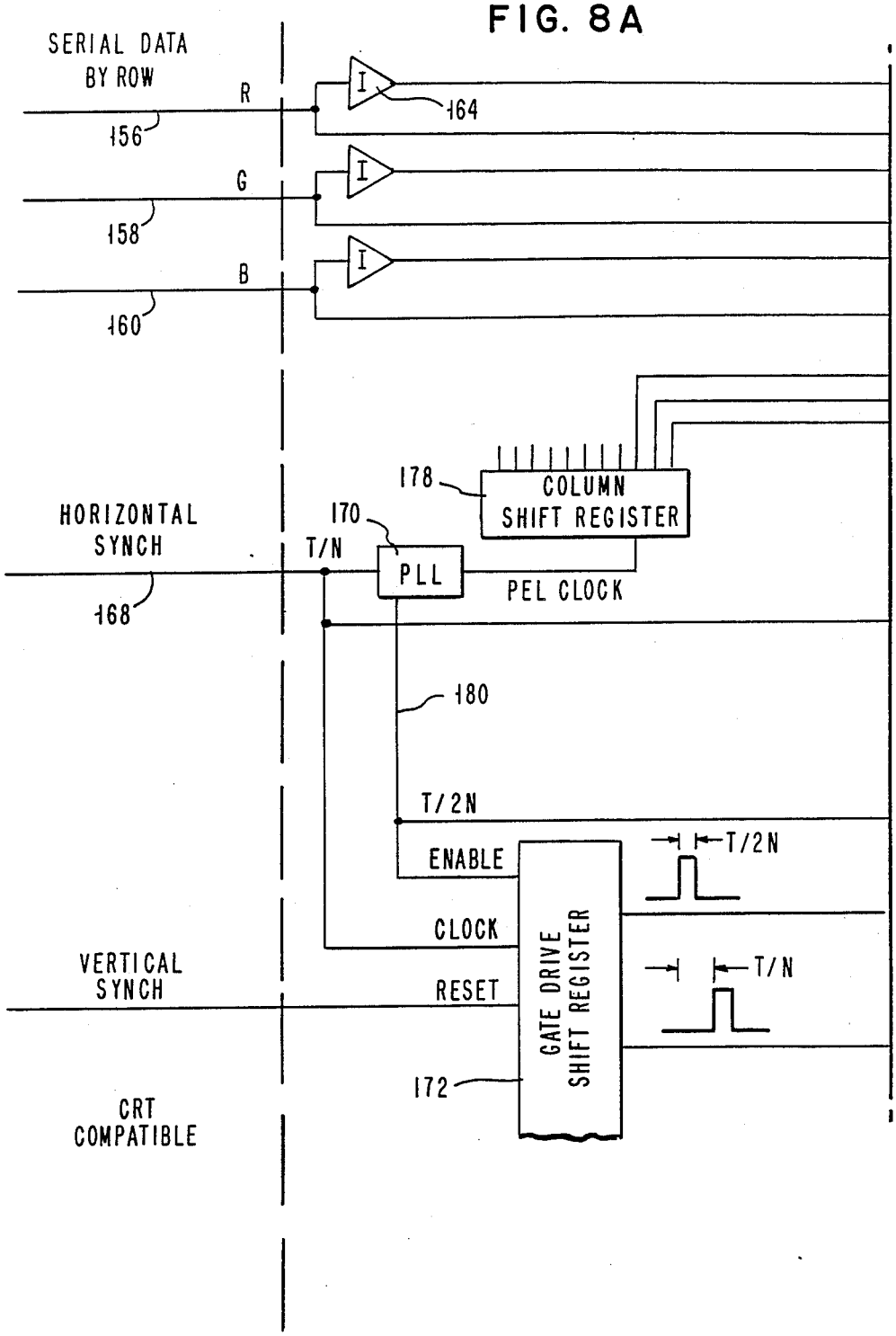
FIGS. 8A and 8B are schematic diagrams of the addressing circuits for a color TFT/LCD array being driven with a standard color CRT monitor interface.
Figure 8B:
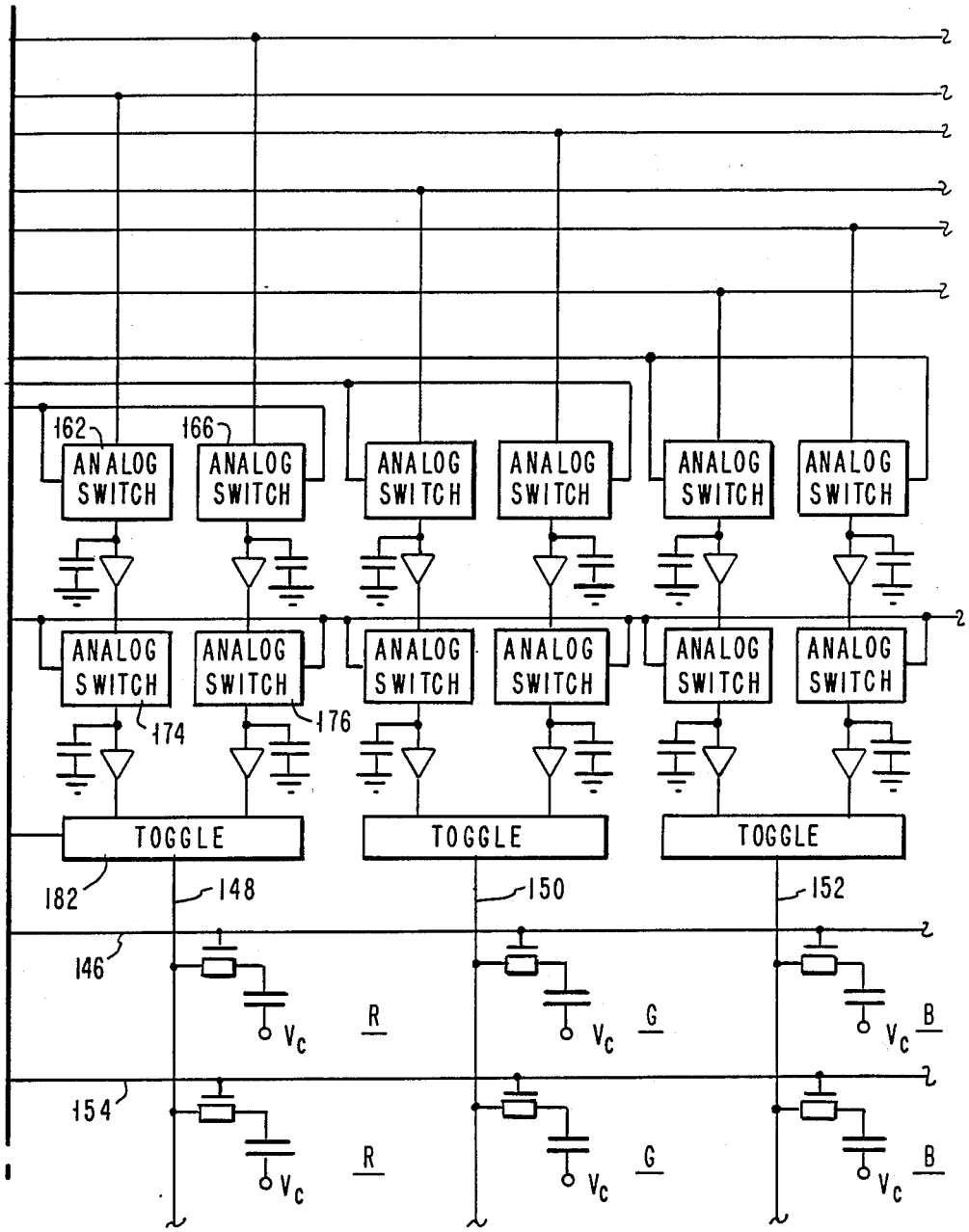

FIG. 8 is a schematic of the addressing implementation for a color TFT/LCD array, driven by a standard CRT monitor interface, in which the red (R), green (G) and blue (B) are in vertical stripes in the matrix. The basic operation of this circuit is similar to that set forth for FIG. 7, therefore only the differences will be described in detail.

Each pel position in the matrix is comprised of a R, G and B position. For example, pel 1 position in row 1 at the matrix is comprised of: a R position the intersection of line 146 with line 148; a G position, the intersection of line 146 with line 150; and a B position, the intersection of line 146 with line 152. Pel 1 position in row 2 of the matrix is comprised of: a R position, the intersection of line 154 with line 148; a G position, the intersection of line 154 with line 150; and a B position, the intersection of line 154 with line 152.

Serial data by row in the form of R, G and B color data, which is CRT compatible, is provided on lines 156, 158 and 160, respectively from a video RAM (not shown). Rather than a single analog toggle 48 (FIG. 7), there is an analog switch for each of the data signals and the crosstalk compensation signal for each row. The R data signal for pel 1 is applied to analog switch 162, and the crosstalk compensation signal is applied via inverter 164 to analog switch 166. The G and B data and crosstalk compensation signals are connected in a like manner.

A horizontal synch signal is applied via line 168 to a phase-locked-loop (PLL) pel clock generator 170, the clock input of a gate driver shift register 172 and a plurality of analog switches such as the switches 174 and 176. The pel clock generator provides pel clock pulses to a column shift register 178 which in sequence turns on the analog switches, for example, 162 and 166 a pel position at a time for each row, similar to shift register 54 (FIG. 7). The pel clock signals are also applied via line 180 as an enable signal to shift register 172 and a switching signal to toggles 182, 184 and 186. These toggles are needed to switch from the data signal to the crosstalk compensation signal. For example, when toggle 182 is in one state the data signal provided from switch 174 is applied to line 148, and when in the other state the crosstalk compensation signal from switch 176 is applied to line 148.

The CRT compatible circuit described above, functions in a manner similar to the described for FIG. 7 in accomplishing crosstalk elimination.

Industrial Applicability

It is an object of the invention to provide a method of reducing crosstalk in a thin film transistor/liquid crystal display (TFT/LCD).

It is another object of the invention to provide a method of reducing crosstalk in a TFT/LCD comprised of a matrix of cells, each cell being defined by the orthogonal intersection of one of a first plurality of data lines and a second plurality of gate lines, with a given cell being turned on in response to the data line and the gate line that intersect at the cell having a data signal and a gating signal, respectively, applied thereto, by applying a gating signal to one of said gate lines for at least one half of the standard scan line time for the display and not applying the gating signal for the remainder of the standard scan line time, with a data signal being applied to one of said data lines when the gating signal is applied and a crosstalk compensation signal being applied when the gating signal is not applied.

Having thus described our invention, what we claim as new, and desire to secure by Letters Patent is:

1. A method of reducing crosstalk in a display comprised of a matrix of thin film transistor/liquid crystal display cells, each cell being defined by the intersection of one of a first plurality of data lines extending in a first direction and one of a second plurality of gate lines extending in a second direction which is at an angle to said first direction, with a given cell being turned on in response to the data line and the gate line that intersect at the cell having a data signal and a gating signal, respectively, applied thereto, said method comprising the steps of:

turning on a gating signal for a time period less than the standard scan line time period of said display for applying said gating signal to one of said gate lines, and turning off said gating signal for the remainder of said standard scan line time period;

applying a data signal to one of said data lines concurrent with said gating signal being turned on for turning on the cell at the intersection of said one of said gate lines and said one of said data lines; and applying a crosstalk compensation signal to said one of said data lines concurrent with said gating signal being turned off, for reducing any crosstalk produced in the other cells connected to said one of said data lines as a result of the application of said data signal thereto.

2. The method of claim 1, wherein said crosstalk compensation signal is a function of the complement of said data signal.

3. A method of reducing crosstalk in a display comprised of a matrix of thin film transistor/liquid crystal display cells, each cell being defined by the intersection of one of a first plurality of data lines extending in a first direction and one of a second plurality of gate lines extending in a second direction which is at an angle to said first direction, with a given cell being turned on in response to the data line and the gate line that intersect at the cell having a data signal and a gating signal, respectively, applied thereto, said method comprising the steps of:

turning on a gating signal for a time period less than the standard scan line time period of said display, for applying said gating signal to one of said gate lines, and turning off said gating signal for the remainder of said standard scan line time period; and applying a two level signal, comprised of a first level and a second level, to one of said data lines for the standard scan line period of said display, with said first level comprising a data signal for turning on the cell at the intersection of said one of said gate lines and said one of said data lines, and said second level comprising a crosstalk compensation signal, for reducing any crosstalk produced in the other cells connected to said one of said data lines as a result of the application of said data signal thereto, said two level signal being at the first level concurrent with said gating signal being turned on and at said second level concurrent with said gating signal being turned off.

4. A method of reducing crosstalk in a display comprised of a matrix of thin film transistor/liquid crystal display cells, each cell being defined by the intersection of one of a first plurality of data lines extending in a first direction and one of a second plurality of gate lines extending in a second direction which is at an angle to said first direction, with a given cell being turned on in response to the data line and the gate line that intersect at the cell having a data signal and a gating signal, respectively, applied thereto, said methods comprising the steps of:

turning on a gating signal for a time period less than the standard scan line time period of said display for application to one of said gate lines;

applying a data signal of a first level to one of said data lines concurrent with said gating signal being turned on for turning on the cell at the intersection of said one gate line and said one data line;

turning off said gating signal for the remainder of said standard scan line period; and applying a crosstalk compensation signal of a second level, to said one of said data lines, concurrent with said gating signal being turned off, for reducing the effect of crosstalk in at least the other cells connected to said one data line, as a result of the application of said data signal thereto.

5. The method of claim 4, wherein said crosstalk compensation signal is a function of the complement of said data signal.

6. A method of reducing crosstalk in a display comprised of a matrix of thin film transistor/liquid crystal display cells, each cell being defined by the orthogonal intersection of one of a first plurality of data lines and one of a second plurality of gate lines, with a given cell being turned on in response to the data line and the gate line that intersect at the cell having a data signal and a gating signal, respectively, applied thereto, said method comprising the steps of:

applying a gating signal to one of said gate lines for at least one half of the standard scan line time for said display, and not applying said gating signal to said one of said gate lines for the remainder of said standard scan line time;

applying a data signal to one of said data lines, concurrent with said gating signal being applied, for turning on the one cell at the intersection of said one gate line and said one data line; and applying a crosstalk compensation signal, concurrent with said gating signal not being applied to said one data line for reducing the crosstalk produced in at least the other cells connected to said one data line, as a result of the application of said data signal thereto.

7. A method of reducing crosstalk in a display comprised of a matrix of thin film transistor/liquid crystal display cells, each cell being defined by the orthogonal intersection of one of a first plurality of data lines and a second plurality of gate lines with a given cell being turned on in response to the data line and the gate line taht intersect at the cell having a data signal and a gating signal, respectively, applied thereto, with said display having a frame period T, and N gate lines, with Vi being the data signal for a cell, Vm being a fixed voltage which may be zero, $\delta$ is the fraction of the scan line time T/N that a gate and data signal are concurrently on, and $\gamma$ is a scaling factor for compensation of pulse amplitude, said method comprising the steps of:

turning on a gating signal during the time period $(0-\delta T/N)$, and turning off said gating signal during the time period $(T/N-\delta T/N)$ for application to one of said gate lines; and applying a composite signal to one of said data lines for the scan line time T/N, with said composite signal comprising said data signal Vi during the time said gating signal is on for turning on the cell at the intersection of said one of said gate lines and said one of said data lines, and comprising a crosstalk compensation signal $\gamma(Vm-Vi)$ during the time said gating signal is off, with said crosstalk compensation signal reducing the effect of crosstalk in at least the other cells connected to said one data line, as a result of the application of said data signal Vi thereto.

8. The method of claim 7, wherein $\delta$ has a value in the range of $0 \leqq \delta \leqq 1$ and $\gamma$, corresponding to the chosen $\delta$ value, is defined by $\gamma^2=\delta/(1-\delta)$.

9. The method of claim 8, wherein the compensation signal, defined by $Vm-Vi$, may be derived from any convenient value of $\pm Vm$, including zero.

10. In a display comprised of a matrix of thin film transistor/liquid crystal display cells, each cell being defined by the intersection of one of a first plurality of data lines extending in a first direction and one of a second plurality of gate lines extending in a second direction which is at an angle to said first direction, with a given cell being turned on in response to the data line and the gate line that intersect at the cell having a data signal and a gating signal, respectively, applied thereto, the combination comprising:

means for turning on a gating signal for a time period less than the standard scan line time period of said display for applying said gating signal to one of said gate lines, and turning off said gating signal for the remainder of said standard scan line time period;

means for applying a data signal to one of said data lines concurrent with said gating signal being turned on for turning on the cell at the intersection of said one of said gate lines and said one of said data lines; and means for applying a crosstalk compensation signal to said one of said data lines concurrent with said gating signal being turned off, for reducing any crosstalk produced in at least the other cells connected to said one of said data lines as a result of the application of said data signal thereto.

11. The combination claimed in claim 10, wherein said crosstalk compensation signal is a function of the complement of said data signal.

12. In a display comprised of a matrix of thin film transistor/liquid crystal display cells, each cell being defined by the intersection of one of a first plurality of data lines extending in a first direction and one of a second plurality of gate lines exceeding in a second direction which is at an angle to said first direction, with a given cell being turned on in response to the data line and the gate line that intersect at the cell having a data signal and a gating signal, respectively, applied thereto, the combination comprising:

means for turning on a gating signal for a time period less than the standard scan line time period of said display, for applying said gating signal to one of said gate lines, and turning off said gating signal for the remainder of said standard scan line time period; and means for applying a two level signal, comprised of a first level and a second level, to one of said data lines for the standard scan line period of said display, with said first level comprising a data signal for turning on the cell at the intersection of said one of said gate lines and said one of said data lines, and said second level comprising a crosstalk compensation signal, for reducing any crosstalk produced in the other cells connected to said one of said data lines as a result of the application of said data signal thereto, said two level signal being at the first level concurrent with said gating signal being turned on and at said second level concurrent with said gating signal being turned off.

13. In a display comprised of a matrix of thin film transistor/liquid crystal display cells, each cell being defined by the intersection of one of a first plurality of data lines extending in a first direction and one of a second plurality of gate lines extending in a second direction which is at an angle to said first direction, with a given cell being turned on in response to the data line and the gate line that intersect at the cell having a data signal and a gating signal, respectively, applied thereto, the combination comprising:

means for turning on a gating signal for a time period less than the standard scan line time period of said display for application to one of said gate lines;

means for applying a data signal of a first level to one of said data lines concurrent with said gating signal being turned on for turning on the cell at the intersection of said one gate line and said one data line;

means for turning off said gating signal for the remainder of said standard scan line period; and means for applying a crosstalk compensation signal of a second level, to said one of said data lines, concurrent with said gating signal being turned off, for reducing the effect of crosstalk in at least the other cells connected to said one data line, as a result of the application of said data signal thereto.

14. The combination claimed in claim 13, wherein said crosstalk compensation signal is a function of the complement of said data signal.

15. In a display comprised of a matrix of thin film transistor/liquid crystal display cells, each cell being defined by the orthogonal intersection of one of a first plurality of data lines and one of a second plurality of gate lines, with a given cell being turned on in response to the data line and the gate line that intersect at the cell having a data signal and a gating signal, respectively, applied thereto, the combination comprising:

means for applying a gating signal to one of said gate lines for at least one half of the standard scan line time for said display, and not applying said gating signal to said one of said gate lines for the remainder of said standard scan line time;

means for applying a data signal to one of said data lines, concurrent with said gating signal being applied, for turning on the one cell at the intersection of said one gate line and said one data line; and means for applying a crosstalk compensation signal, concurrent with said gating signal not being applied to said one data line for reducing the crosstalk in at least the other cells connected to said one data line, as a result of the application of said data signal thereto.

16. In a display comprised of a matrix of thin film transistor/liquid crystal display cells, each cell being defined by the orthogonal intersection of one of a first plurality of data lines and a second plurality of gate lines with a given cell being turned on in response to the data line and the gate line that intersect at the cell having a data signal and a gating signal, respectively, applied thereto, with said display having a frame period T, and N gate lines, with Vi being the data signal for a cell, Vm being a fixed voltage which may be zero, $\delta$ is the fraction of the scan line time T/N that a gate and data signal are concurrently on, and $\gamma$ is a scaling factor for compensation of pulse amplitude, the combination comprising:

means for turning on a gating signal during the time period $(0-\delta T/N)$, and turning off said gating signal during the time period $(\delta T/N-T/N)$ for application to one of said gate lines; and means for applying a composite signal to one of said data lines for the scan line time T/N, with said composite signal comprising said data signal Vi during the time said gating signal is on for turning on the cell at the intersection of said one of said gate lines and said one of said data lines, and comprising a crosstalk compensation signal $\gamma(Vm-Vi)$ during the time said gating signal is off, with said crosstalk compensation signal reducing the effect of crosstalk in at least the other cells connected to said one data line, as a result of the application of said data signal Vi thereto.

17. The combination claimed in claim 16, wherein $\delta$ has a value in the range of $0 \leqq \delta \leqq 1$ and $\gamma$, corresponding to the chosen $\delta$ value, is defined by $\gamma^2=\delta/(1-\delta)$.

18. The combination claimed in claim 16, wherein the compensation signal, defined by $Vm-Vi$, may be derived from any convenient value of $\pm Vm$, including zero.

* * * * *